US007216403B2

(12) United States Patent
Decker

(10) Patent No.: US 7,216,403 B2
(45) Date of Patent: May 15, 2007

(54) ERGONOMIC APPLIANCE HANDLE

(76) Inventor: Deborah Decker, 25241 Darlington Ln., Mission Viejo, CA (US) 92692

( * ) Notice: Subject to any disclaimer, the term of this patent is extended or adjusted under 35 U.S.C. 154(b) by 236 days.

(21) Appl. No.: 10/927,398

(22) Filed: Aug. 27, 2004

(65) Prior Publication Data

US 2006/0042046 A1 Mar. 2, 2006

(51) Int. Cl.
*B25G 1/00* (2006.01)

(52) U.S. Cl. ..... 16/430; 16/426; 16/427; 16/436

(58) Field of Classification Search ..... 16/422, 16/425–427, 429, 430, 440, 436, DIG. 24, 16/DIG. 41; 15/22.1, 145, 144.2, 144.1; 220/696, 759, 768, 769; 403/62, 68, 70; 248/520, 291.1

See application file for complete search history.

(56) References Cited

U.S. PATENT DOCUMENTS

| | | | | | |
|---|---|---|---|---|---|
| 1,871,146 | A * | 8/1932 | Bosler | 403/55 |
| 2,663,979 | A * | 12/1953 | Gerardo | 451/522 |
| 2,834,035 | A * | 5/1958 | Vosbikian et al. | 15/119.1 |
| 2,959,799 | A * | 11/1960 | Greenleaf et al. | 15/119.2 |
| 3,773,375 | A * | 11/1973 | Nehls | 37/268 |
| 3,897,607 | A | 8/1975 | Schaffer et al. | |
| 4,475,262 | A * | 10/1984 | Downer | 15/210.1 |
| 4,662,026 | A | 5/1987 | Sumerau et al. | |
| 5,507,071 | A | 4/1996 | Berfield | |
| 5,819,364 | A | 10/1998 | Sham | |
| 5,850,667 | A | 12/1998 | Orsini | |
| 5,940,933 | A * | 8/1999 | Chang | 16/439 |
| 6,370,725 | B1 * | 4/2002 | Carlson | 15/119.2 |
| 6,742,222 | B2 | 6/2004 | Furr-Britt et al. | |
| 6,746,062 | B2 * | 6/2004 | Bielecki et al. | 294/7 |
| 2002/0124345 | A1 | 9/2002 | Holsten et al. | |
| 2002/0124347 | A1 | 9/2002 | Roney et al. | |
| 2003/0031510 | A1 * | 2/2003 | Suriano | 404/118 |
| 2003/0101534 | A1 | 6/2003 | Noreen et al. | |
| 2003/0229964 | A1 | 12/2003 | Thompson et al. | |
| 2004/0031116 | A1 * | 2/2004 | Coleman | 15/172 |

* cited by examiner

*Primary Examiner*—Chuck Y. Mah
*Assistant Examiner*—Michael J. Kyle
(74) *Attorney, Agent, or Firm*—Richard C. Litman

(57) ABSTRACT

The ergonomic appliance handle is an extension handle that is attachable to a carrying or transport handle on a canister style vacuum cleaner or similar floor appliance. The ergonomic appliance handle provides an elongated handle shaft that is attached to the canister vacuum's handle at a proximate end of the handle shaft by a mounting assembly. The handle shaft extends angled upward, away from the vacuum, placing a handgrip at the distal end of the handle shaft at an ergonomically comfortable height and position for a user to easily and conveniently operate the vacuum in a comfortable posture without subjecting the user to unnecessary bending, stooping, or twisting.

8 Claims, 9 Drawing Sheets

ERGONOMIC APPLIANCE HANDLE

BACKGROUND OF THE INVENTION

1. Field of the Invention

The present invention relates to handles and similar attachments for various devices, and more particularly to an ergonomic appliance handle that provides an ergonomic improvement to a vertically oriented canister style vacuum cleaner or other floor appliance.

2. Description of the Related Art

Vertical canister type vacuum cleaners are widespread in use in homes, commercial settings, and many other places. Vertical canister type vacuum cleaners (canister vacuums) generally have a cylindrical main housing disposed vertically on a plurality of wheels, some or all of the wheels being pivoting or caster type wheels. The housing contains a motor and vacuum mechanism, as well as a collection receptacle such as a filter bag, or a bag-less drum or water reservoir. An intake opening and an exhaust opening in the housing are connected to the vacuum mechanism, whereby air, along with dirt, particulate matter, and other objects are drawn into the collection receptacle, the air being discharged through the exhaust opening.

In use, a proximal end of a flexible hose is attached to the intake opening. The distal end of the hose is used, generally along with a cleaning attachment, accessory, or power nozzle, attached to the distal end for cleaning tasks.

Canister vacuums are advantageous over traditional upright vacuum cleaners. Because cleaning accessories, including power nozzles such as for vacuuming, shampooing, or steam cleaning carpets, are essentially separate from the main housing, they are of relatively light weight. Thus, a person operating the canister vacuum may maneuver the cleaning accessory at the end of the flexible hose during cleaning tasks, within the range of freedom of the hose, without the need to maneuver the main housing. In contrast, operating an upright machine requires a user to maneuver the machine's entire weight. Thus, because a canister vacuum requires only movement of the relatively lightweight hose and cleaning accessory during much of a cleaning task, the canister vacuum presents a lighter workload and less mechanical strain on a user's body, and in particular on a user's back. A user may remain in an upright posture, expending minimal strength to perform cleaning tasks, presenting an ergonomic and body-mechanical advantage.

Of course, during the course of operating a canister vacuum, it will become necessary from time to time to move the main housing itself, as the hose and cleaning accessory reach their maximum extent from the main housing. Generally, the main housing is simply pulled along by the hose to a new position wherein the hose and cleaning accessory are again operable unencumbered by the main housing.

During the course of moving a canister vacuum, some situations are encountered that compromise the ergonomic advantage of the canister vacuum. As a canister vacuum is pulled from place to place by its hose, the canister vacuum trails the user by the length of the hose. To draw the canister vacuum closer, the user may need to bend, twist, or stoop to reach along the hose to pull the canister vacuum closer, contorting a normal and comfortable posture. Such actions place a strain on the user's body and in particular the lumbar-sacral area of the user's lower back.

Additionally, as a canister vacuum is pulled from room to room, or area to area, the canister vacuum's wheels are likely to encounter obstacles such as carpet edges, door thresholds, and the like that prevent further rolling movement of the canister vacuum. Simply pulling harder on the hose risks pulling the hose free from the main housing, or tipping over the canister vacuum entirely. Either case requires a corrective intervention by the user to either re-attach the hose, or to upright the canister vacuum, both operations requiring bending and/or twisting by the user that present the potential for back strain and other bodily injury. The alternative to pulling harder on the hose to overcome the obstruction is to lift the canister vacuum over the obstruction, again risking back strain or other injury. In addition to the obstacles of carpet edges, door thresholds, and the like, additional obstacles, such as furniture, require the user to stop and bend, stoop, or twist to guide the canister vacuum around the obstacles. Also, on certain flooring surfaces the caster wheels may tend to guide the canister vacuum in an erratic path as it is pulled, requiring the user to intervene to prevent the canister vacuum from bumping walls, furniture, and such.

An additional drawback to moving a canister vacuum by simply pulling the canister vacuum along by its hose is that, because the hose is flexible, the canister vacuum cannot be pushed, or maneuvered backwards, by the hose. Again, user intervention is required that requires the user to bend, stoop, twist, or stretch in a manner that may cause injury.

Various handle configurations have been employed to provide an ergonomic advantage for vacuum cleaners and other types of floor appliances.

U.S. Pat. No. 6,742,222, issued on Jun. 1, 2004 to T. Furr-Britt et al., discloses a dual handle attachment for an upright floor appliance. A single central bracket attaches to the conventional single handlebar of an appliance, such as an upright vacuum cleaner, with a left and a right handgrip adjustably extending from the central bracket. The dual handle attachment allows a user to maneuver the appliance using generally symmetric upper body, arm, wrist, and hand forces.

U.S. Pat. No. 3,897,607, issued on Aug. 5, 1975 to R. Schaffer et al., discloses a readily removable implement handle for a vacuum cleaner, tool, floor scrubber, sweeper, or other device. Insertion means disposed on the handle releasably engage with receiving means affixed to the device, the handle including a locking means in the form of a spring.

U.S. Pat. No. 5,507,071, issued on Apr. 16, 1996 to R. Berfield, discloses a U-shaped handle that is attachable to a motor housing of a vacuum apparatus to carry or lift the appliance.

U.S. Pat. No. 5,819,364, issued on Oct. 13, 1998 to J. Sham, discloses a detachable handle accessory for a handheld portable steam vacuum cleaner. The handle accessory includes a support base for mounting the portable steam vacuum cleaner, a handle portion extending upwardly from the support base, and a wheel assembly affixed to the support base. The handle converts the handheld portable steam vacuum cleaner into an upright steam vacuum cleaner.

U.S. Patent Application Publication 2002/0124347, published on Sep. 12, 2002 and applied for by J. Roney et al., discloses a telescoping handle built into an upright vacuum cleaner.

U.S. Patent Application Publication No. 2002/0124345, published on Sep. 12, 2002 and applied for by S. Holsten et al., discloses a vacuum appliance having push and pull handles. The vacuum cleaning appliance is generally of the canister vacuum configuration. A first handle is disposed on a first side of the vacuum appliance, a second handle being disposed on a second side of the vacuum appliance generally opposite the first side.

U.S. Patent Application Publication 2003/0101534, published on Jun. 5, 2003 and applied for by M. Noreen et al., discloses a canister-type vacuum cleaner having a collapsible handle attached to the housing that is adjustable to the height of a user and positioned so that the user can use the handle to move and guide the vacuum cleaner housing.

U.S. Patent Application Publication 2003/0229964, published on Dec. 18, 2003 and applied for by S. Thompson et al., discloses a handled cart that receives a wet/dry vacuum and converts the vacuum into an upright walk behind cleaning device. The cart provides a handle attached to a mobile base.

U.S. Pat. No. 4,662,026, issued on May 5, 1987 to W. Sumerau et al., discloses a convertible vacuum cleaner handle that is convertible between a first position suitable for floor standing operation and a second position suitable for hand carried operation.

U.S. Pat. No. 5,850,667, issued on Dec. 22, 1998 to J. Orsini, discloses an extension handle for a portable vacuum that includes an elongate shaft having a proximal end and a distal end, and a bracket for attaching the shaft to the handle portion of a portable vacuum. The distal end of the shaft is pivotally retained in the bracket such that an on/off switch on the portable vacuum may be operated by the pivoting of the shaft to activate and deactivate the vacuum.

None of the above inventions and patents, taken either singly or in combination, is seen to describe the instant invention as claimed. Thus an ergonomic appliance handle solving the aforementioned problems is desired.

SUMMARY OF THE INVENTION

The ergonomic appliance handle is an extension handle that is attachable to a carrying or transport handle on a vertically oriented canister style vacuum cleaner or similar floor appliance. The ergonomic appliance handle provides an elongated handle shaft that attaches at a proximate end of the handle shaft to the canister vacuum's handle by means of a mounting assembly. The handle shaft extends angled upward and away from the vacuum, placing a handgrip at the distal end of the handle shaft at an ergonomically comfortable height and position for a user to easily and conveniently operate the vacuum in a comfortable posture without subjecting the user to unnecessary bending, stooping, or twisting.

The ergonomic appliance handle allows a user to maneuver the canister vacuum in an ergonomically correct and safe manner by providing the user the ability to both push and pull the vacuum, to maneuver the vacuum around obstacles and obstructions, to more easily move the vacuum over obstructions in the floor surface such as transitions from one floor surface to another, and to more easily control the movement of the vacuum over an uneven flooring surface, thus eliminating situations that require the user to bend, stoop, or twist.

The ergonomic appliance handle provides enhanced ergonomic comfort and convenience for a user, thus complementing the advantages, and overcoming the disadvantages, of the canister style vacuum.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
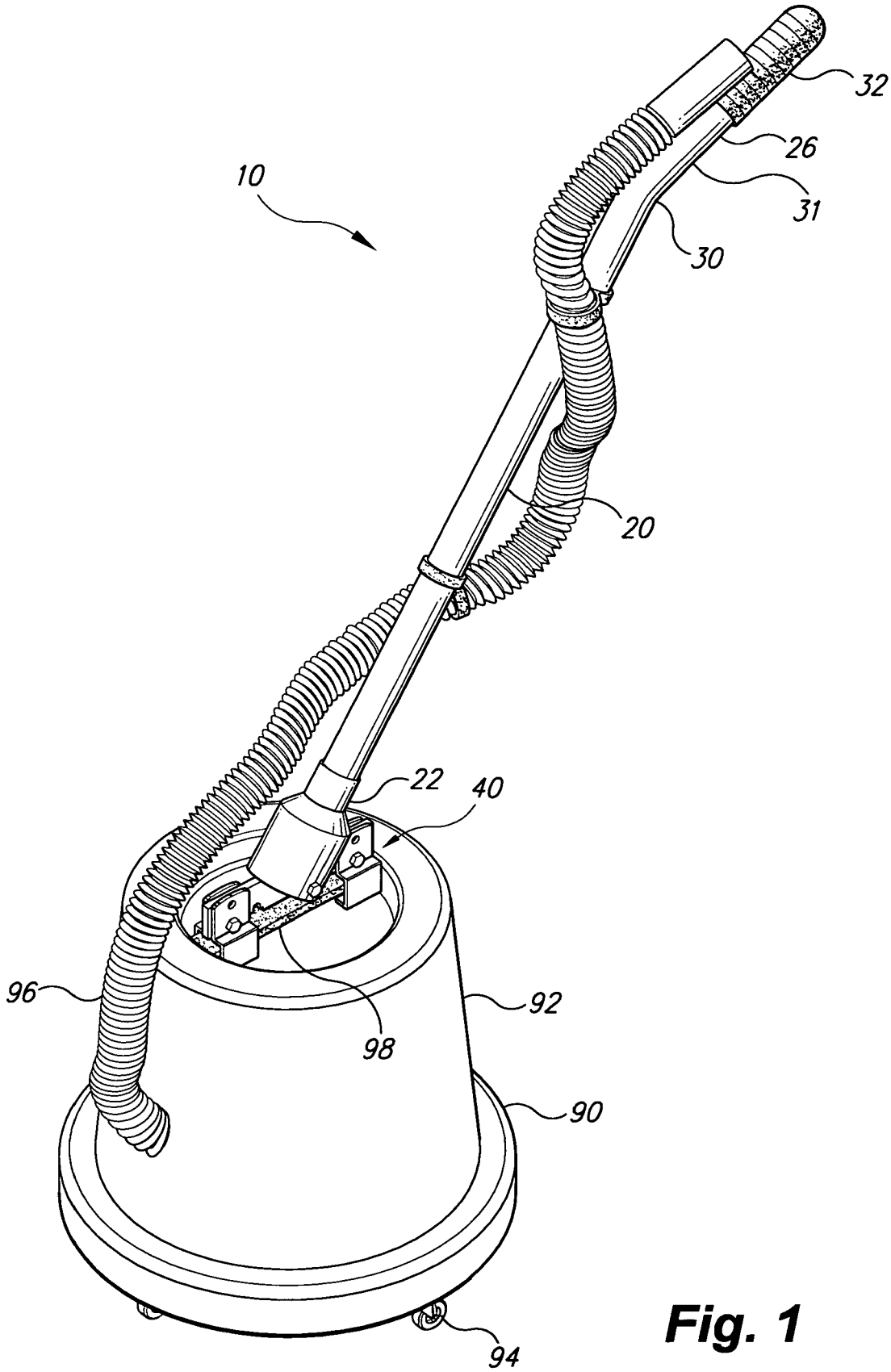
FIG. 1 is an environmental, perspective view of a first embodiment of an ergonomic appliance handle according to the present invention.

The present invention is an ergonomic appliance handle. Referring to FIG. 1, a first embodiment of an ergonomic appliance handle 10 is shown attached to a carry handle 98 of a typical canister vacuum 90. The canister vacuum 90 illustrated is typical of a variety of vacuum cleaning appliances generally comprising a cylindrical housing 92 disposed vertically on a plurality of wheels 94, some or all of the wheels 94 being pivoting or caster type wheels. The housing 92 contains a motor and vacuum mechanism, and a collection receptacle. A proximal end of a flexible hose 96 is attached to an intake opening defined in the housing 92. At a distal end of the flexible hose 96, a cleaning attachment, accessory, or power nozzle, may be attached. A carry handle 98 is generally disposed atop the housing 92, the carry handle 98 lying generally horizontally as the canister vacuum 90 sits on a horizontal surface, such as a floor.

The ergonomic appliance handle 10 comprises an elongated shaft 20 having a proximal end 22 that is attached to the carry handle 98 of the canister vacuum 90 by means of a mounting assembly 40. The elongated shaft 20 extends angled upward and away from the canister vacuum 90, placing the distal end 26 of the elongated shaft 20 at an ergonomically comfortable height and position for a user to easily and conveniently operate the canister vacuum 90 in a comfortable posture without subjecting the user to unnecessary bending, stooping, or twisting. The distal end 26 of the elongated shaft 20 may be straight, or may have a bend 30, the bend forming a handle portion 31, placing the handle portion 31 in a more comfortable gripping position. A handgrip 32 is disposed on the distal end 26 of the elongated shaft 20.

The elongated shaft 20 lies generally within a vertical plane containing the carry handle 98. The angle of the elongated shaft 20, relative to the floor, is generally between about twenty-five degrees (25°) and about forty degrees (40°) for optimal ergonomic use by most users, although angles outside this range may accommodate users with unique or specific needs. The elongated shaft 20 may be pivotally attached to the mounting assembly 40 so that the angle of the elongated shaft 20 may be adjusted. Alternatively, the elongated shaft 20 may be attached in a fixed position. A fixed-position angle between about thirty (30°) to thirty-five degrees (35°) provides a good ergonomic fit for a broad range of users. Again, of course, angles outside this range may used to accommodate users with unique or specific needs.

Figure 2:
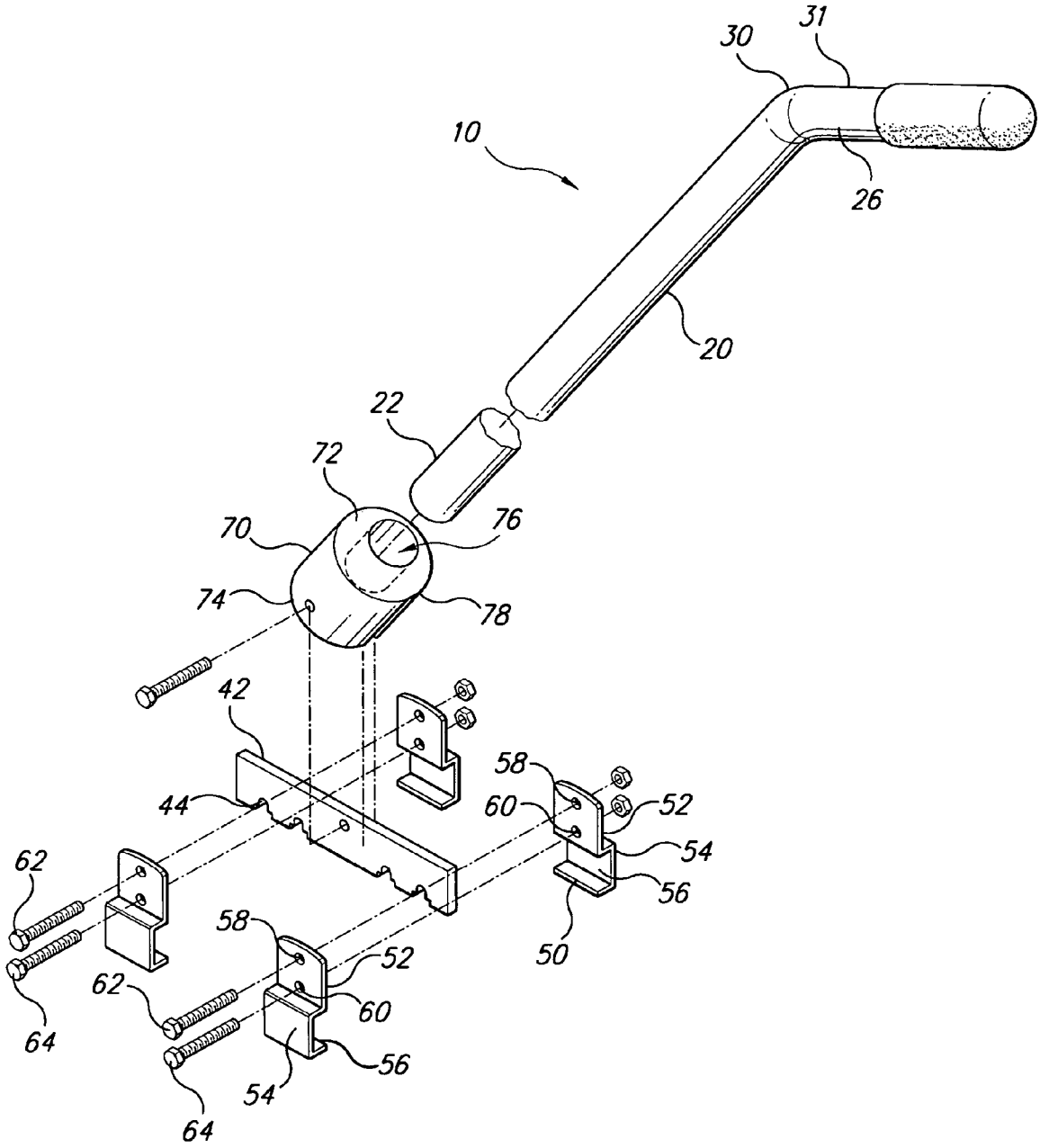
FIG. 2 is an exploded perspective view of the ergonomic appliance handle shown in FIG. 1.

Turning now to FIG. 2, the mounting assembly 40 of the first embodiment is shown in greater detail. A crossbar 42 is attached horizontally above the carry handle 98. The crossbar 42 is a flat, elongated member having a length, width, and thickness. Near each end of the crossbar 42, at least one notched aperture 44 is defined, comprising an aperture formed through the crossbar 42 adjoining a notch extending to a lower edge of the crossbar 42.

At each end of the crossbar 42, a pair of brackets 50 are joined to the crossbar 42 at one of the notched apertures 44. Each of the brackets 50 has a flat top portion 52, and a bottom portion 54 that is bent into a "C" shape defining a channel 56. A pair of apertures, an upper aperture 58 and a lower aperture 60, are defined in the flat top portion 52 of each of the brackets 50, each of the apertures 58, 60 being adapted to receive a fastener, such as a bolt, to join a pair of the brackets 50 cooperatively together. Each of a pair of the brackets 50 are placed facing one another on opposite sides of the crossbar 50 and fastened together, with an upper fastener 62, such as a bolt or rivet or the like, passed through the brackets' 50 upper apertures 58 and through one of the notched apertures 44 to clamp the brackets 50 to the crossbar 42.

The channels 56 of the brackets 50 face one another on opposite sides of the carry handle 98. A lower fastener 64, such as a bolt, is passed through the brackets' 50 lower apertures 60, to clamp the brackets 50 about the carry handle 98, the carry handle 98 being held within the channels 56 of the cooperating brackets 50.

It can be recognized that the notched apertures 44 allow the crossbar 42 to be removed and replaced from between the bracket pairs by loosening, but not fully removing, the upper fasteners 62 and lifting the crossbar 42 to disengage the notched apertures 44 from the fastener 62. It can also be recognized that, with a plurality of notched apertures 44 defined near each end of the crossbar 42, the bracket 50 pairs may be placed at varied distances from one another to accommodate fastening the mounting assembly 40 to canister vacuums having carry handles 98 of various lengths.

A coupling fixture 70 joins the proximal end 22 of the elongated shaft 20 to the crossbar 42. The coupling fixture is a short, cylindrical member having a socket end 72 and a slotted end 74. A cylindrical recess 76 is defined axially within the socket end 72, the cylindrical recess 76 being adapted to receive the proximal end 22 of the elongated shaft 20. The proximal end 22 of the elongated shaft 20 is secured within the cylindrical recess 76 by a bolt or rivet, or other suitable means (not shown). A slot 78 is defined in the slotted end 74 of the coupling fixture 70, whereby the coupling fixture 70 is adapted to fit over the crossbar 42, with the crossbar 42 being received at least partially within the slot 78.

Figure 3:
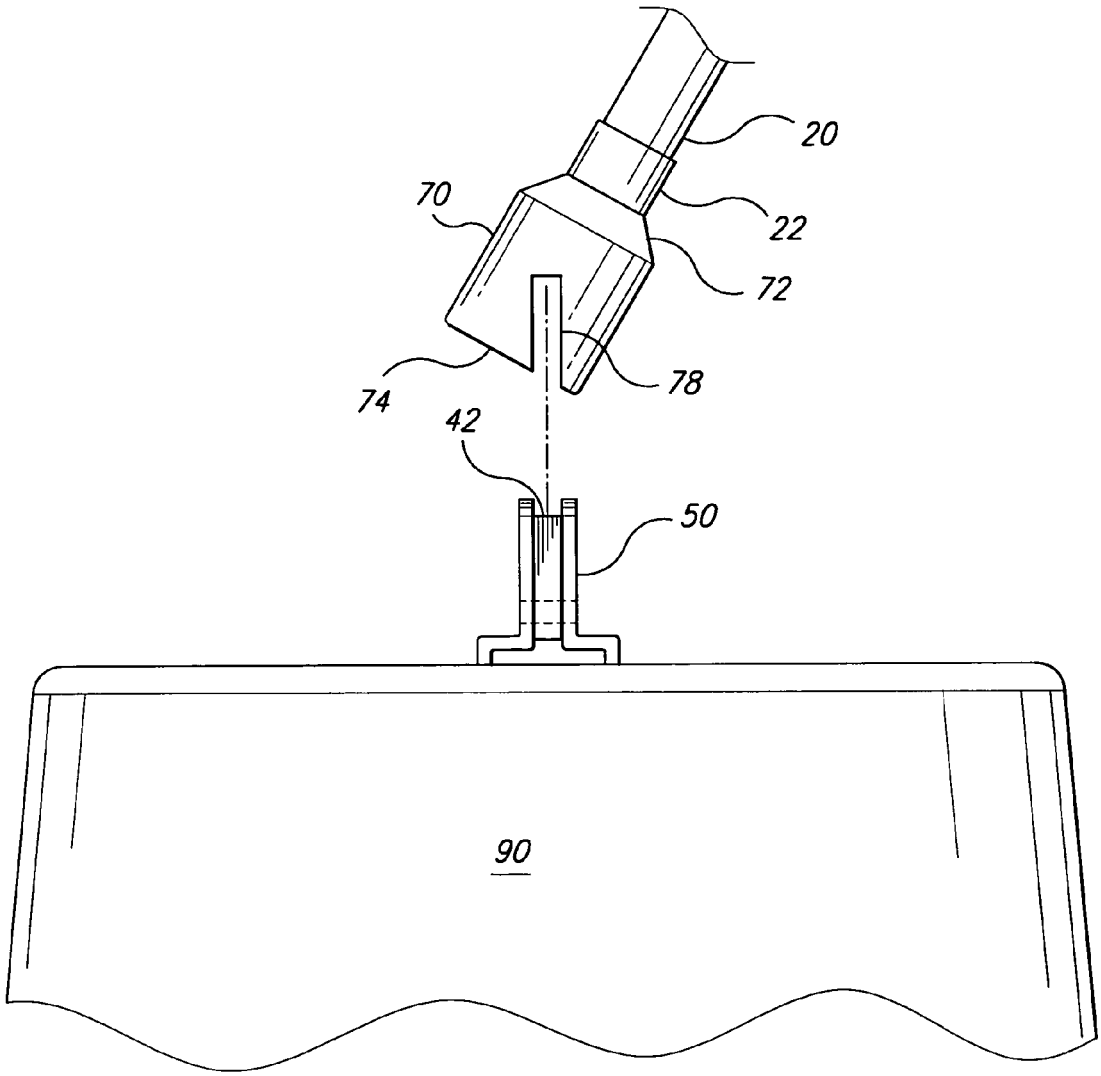
FIG. 3 is a side view showing an alternative coupling fixture for the ergonomic appliance handle of FIG. 1.

Referring to FIG. 3, the coupling fixture 70 is shown having the slot 78 angled so that the elongated shaft 20 lies angled in a plane perpendicular to, rather than within, the vertical plane containing the carry handle 98. This arrangement is useful for certain types of canister vacuum 90 having fixed wheels, rather than caster wheels, in order to prevent movement of the canister vacuum in a given direction.

Figure 4:
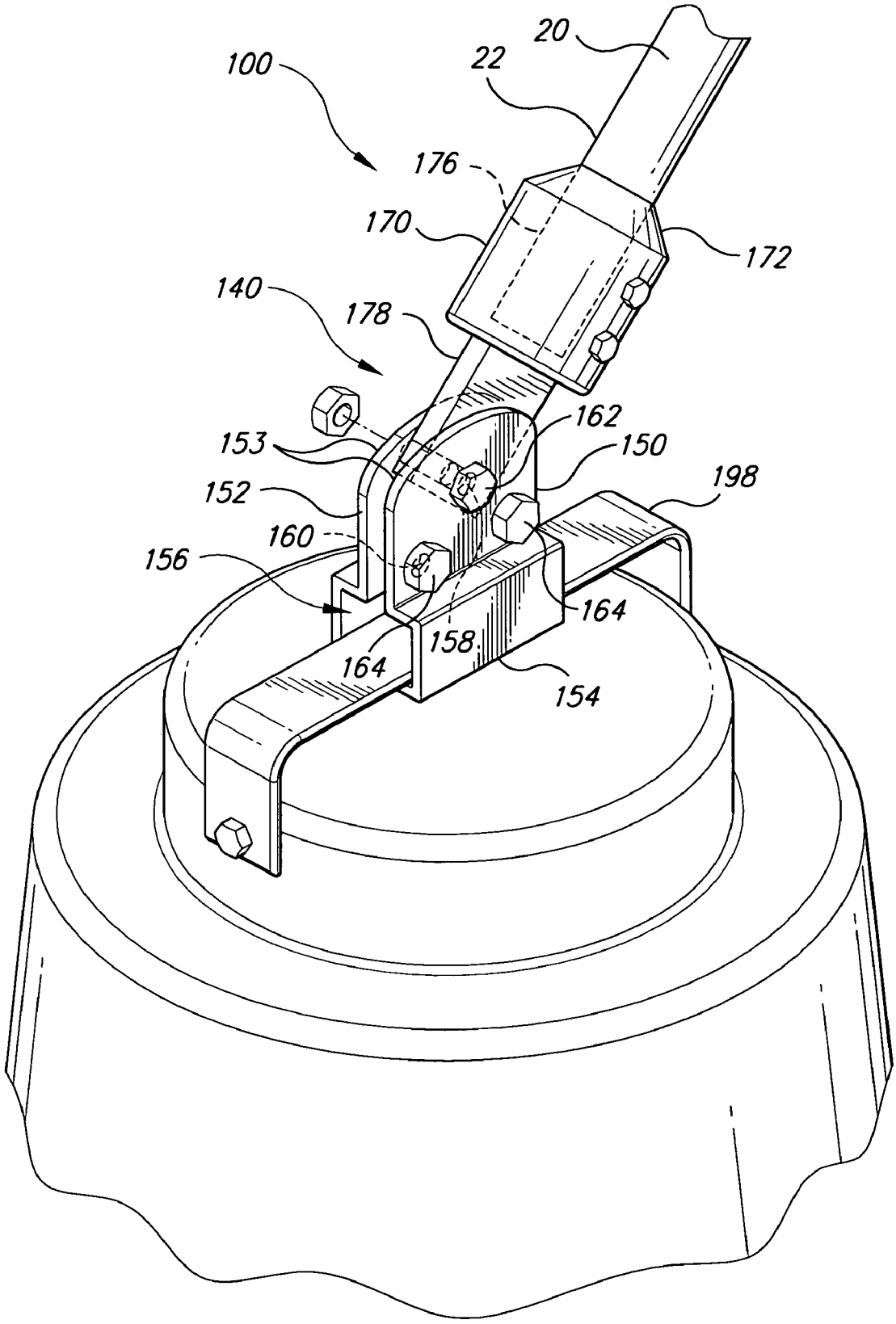
FIG. 4 is an environmental, perspective view of a second embodiment of an ergonomic appliance handle according to the present invention.

Turning now to FIG. 4, a second embodiment of an ergonomic appliance handle 100 is shown attached to a carry handle 198 of a canister vacuum, the horizontal extent of the carry handle 198 being shorter than the carry handle 98 seen in FIG. 1. The ergonomic appliance handle 100 employs a mounting assembly 140 that is better suited to the shorter carry handle 198.

Figure 5:
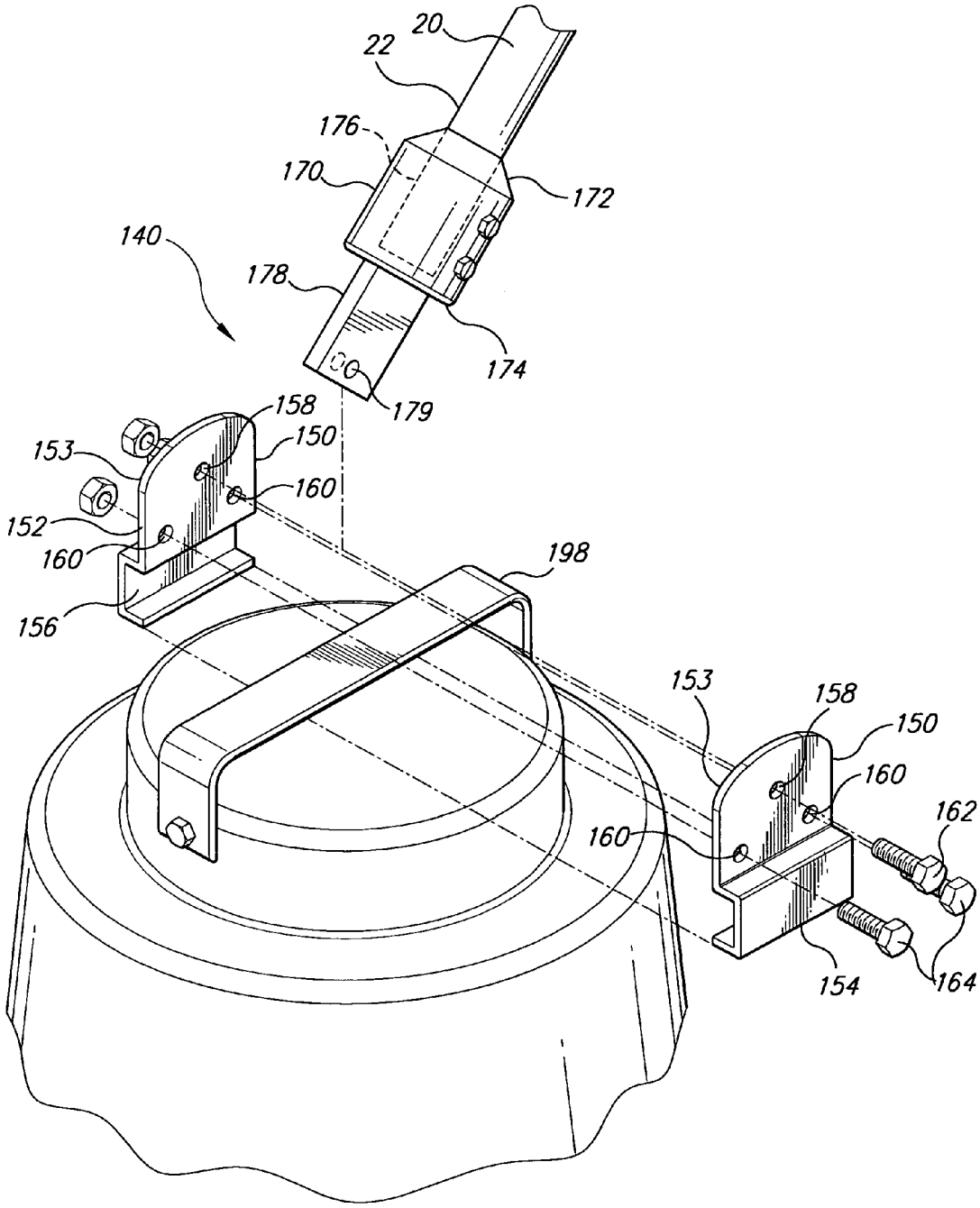
FIG. 5 is an exploded perspective view of the ergonomic appliance handle shown in FIG. 4.

Referring to FIG. 5, the mounting assembly 140 of the second embodiment is shown in greater detail. A single pair of brackets 150 straddles the carry handle 198 and holds a coupling fixture 170 attached to the elongated shaft 20. Each of the brackets 150 has a flat upper portion 152 having an arcuate top edge 153. A bottom portion 154 of each bracket 150 is bent into a "C" shape defining a channel 156. An upper aperture 158, and at least one lower aperture 160 (two are shown) are defined in the upper portion 152 of each of the brackets 150. Each at least one lower aperture 160 receives a lower fastener 164 joining and clamping the two brackets 150 together about the carry handle 198. The brackets 150 are placed facing one another on opposite sides of the carry handle 198, the carry handle 198 engaged between and within the brackets' 150 channels 156. An upper fastener 162 passing through the upper apertures 158 retains the coupling fixture 170 to the brackets 150.

The coupling fixture 170 joins the proximal end 22 of the elongated shaft 20 to the brackets 150. The coupling fixture 170 is a short, cylindrical member having a socket end 172 and a tongue end 174. A cylindrical recess 176 is defined axially within the socket end 172, the cylindrical recess 176 being adapted to receive the proximal end 22 of the elongated shaft 20. A tongue 178 extends from the tongue end 174 of the coupling fixture 170, the tongue 178 being flat and rectangular. An aperture 179 is defined through the tongue 178. The coupling fixture 170 is attached between the upper portions 152 of the brackets 150 by passing upper fastener 162 through the upper apertures 158 and through the aperture 179 of the tongue 178.

Figure 6:
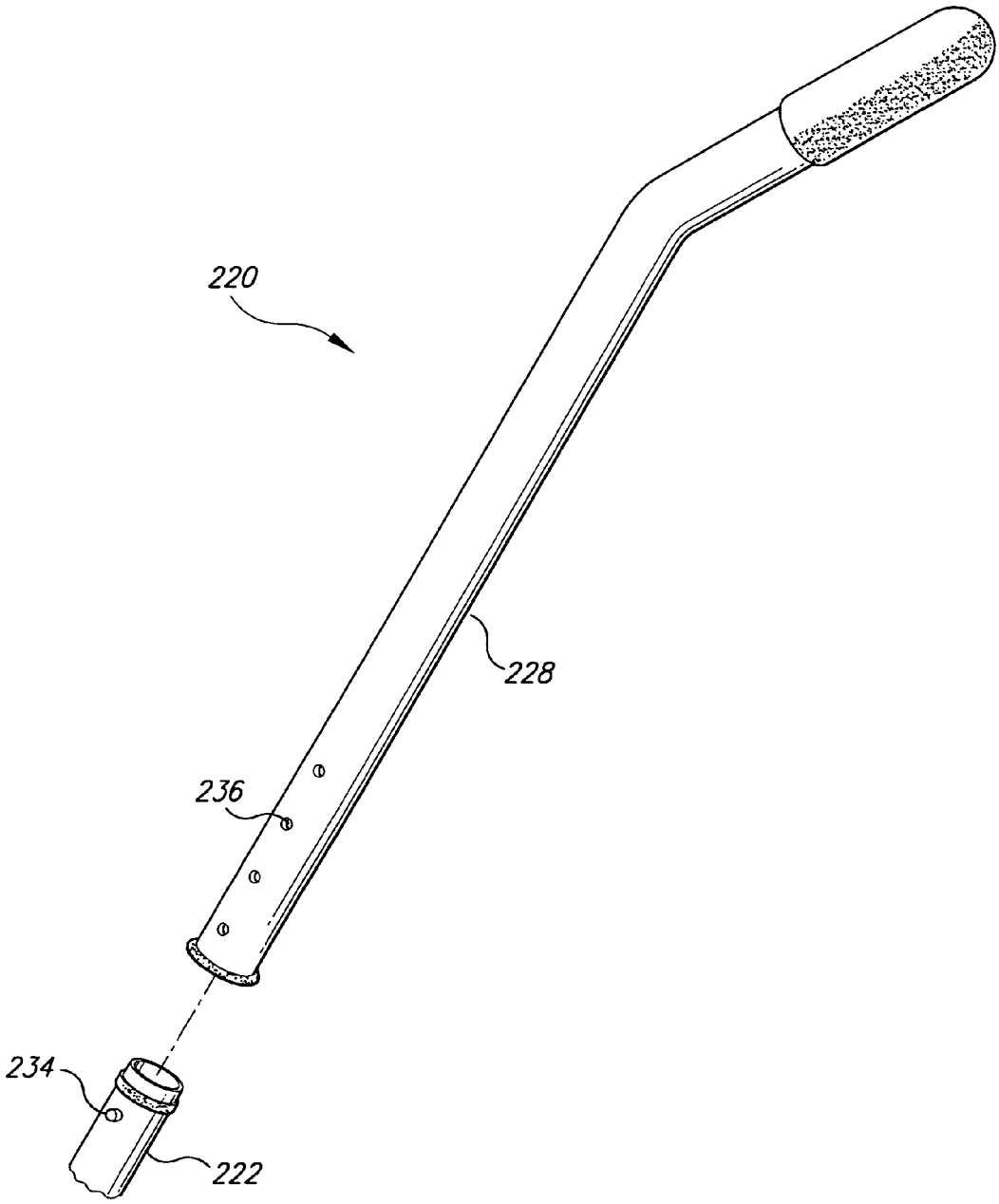
FIG. 6 is an exploded plan view of a telescoping handle shaft for an ergonomic appliance handle.

Turning now to FIG. 6, an elongated shaft 220 is shown comprised of a proximal shaft section 222 telescopically engaged with a distal shaft section 228. A spring-loaded locking pin 234 is disposed on the proximal shaft section 222, the locking pin 234 adapted to engage with one of a plurality of cooperating apertures 236 defined lengthwise along the distal shaft section 228 to secure the proximal shaft section 222 and the distal shaft section 228 together in position. Alternate means of securing the shaft sections 222,228 together may be used, such as a removable pin or the like (not shown) engaged through apertures formed in both shaft sections 222,228, or a locking or clamping collar or fixture (not shown) disposed at the mating end of one of the shaft sections 222,228. Additional, intermediate, telescoping sections (not shown) may be included between the proximal shaft section 222 and the distal shaft section 228, allowing increased extension of the elongated shaft 220.

Figure 7:
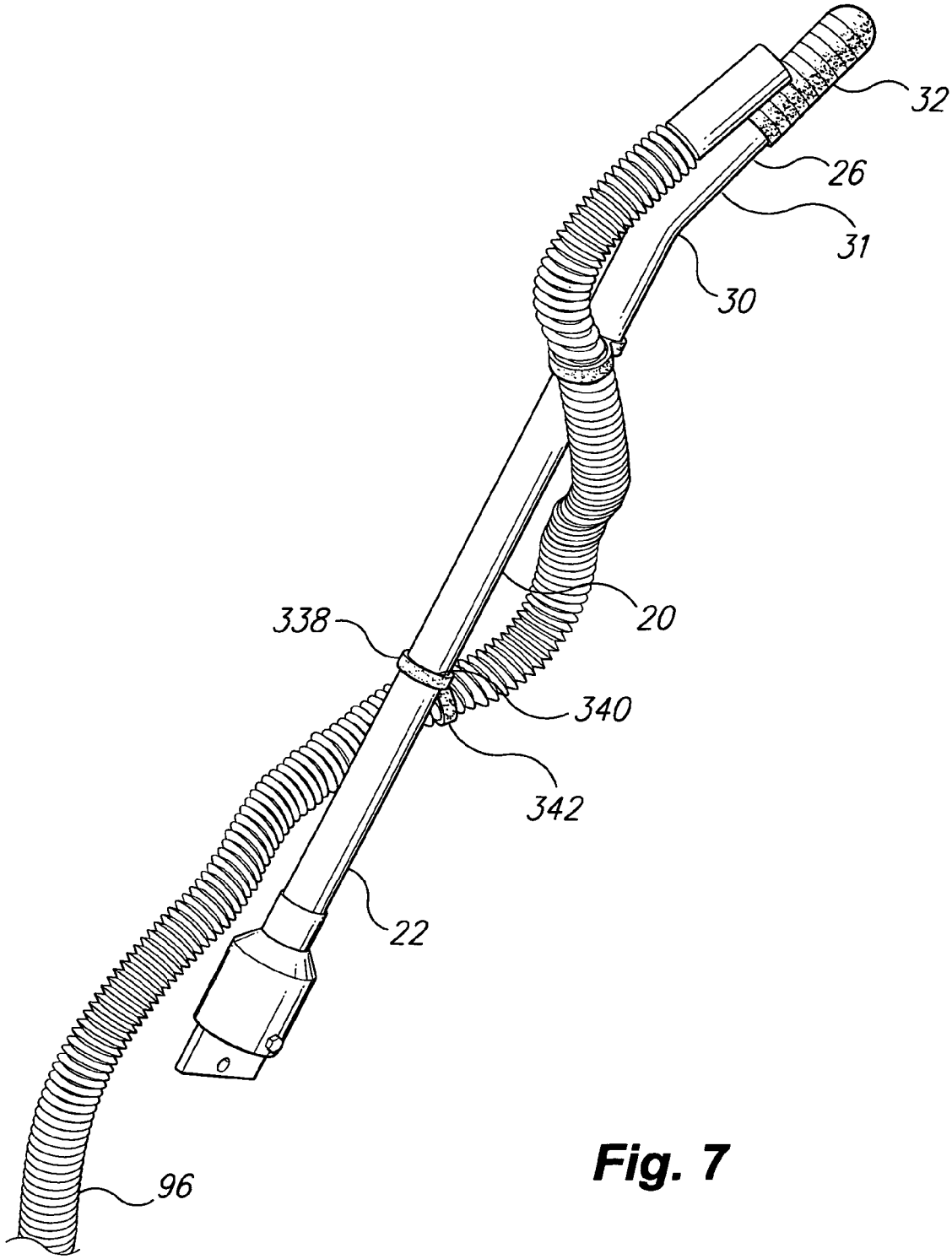
FIG. 7 is a perspective view of a handle shaft for an ergonomic appliance handle including clips for retaining a vacuum hose.

Turning now to FIG. 7, the elongated shaft 20 is shown with at least one hose clip 338 disposed along the elongated shaft 20 to retain the flexible hose 96 of the canister vacuum 90. Each hose clip 338 has a band portion 340 to fasten around the elongated shaft 20 and a clip portion 342 for releasably retaining the flexible hose 96.

Figure 8:
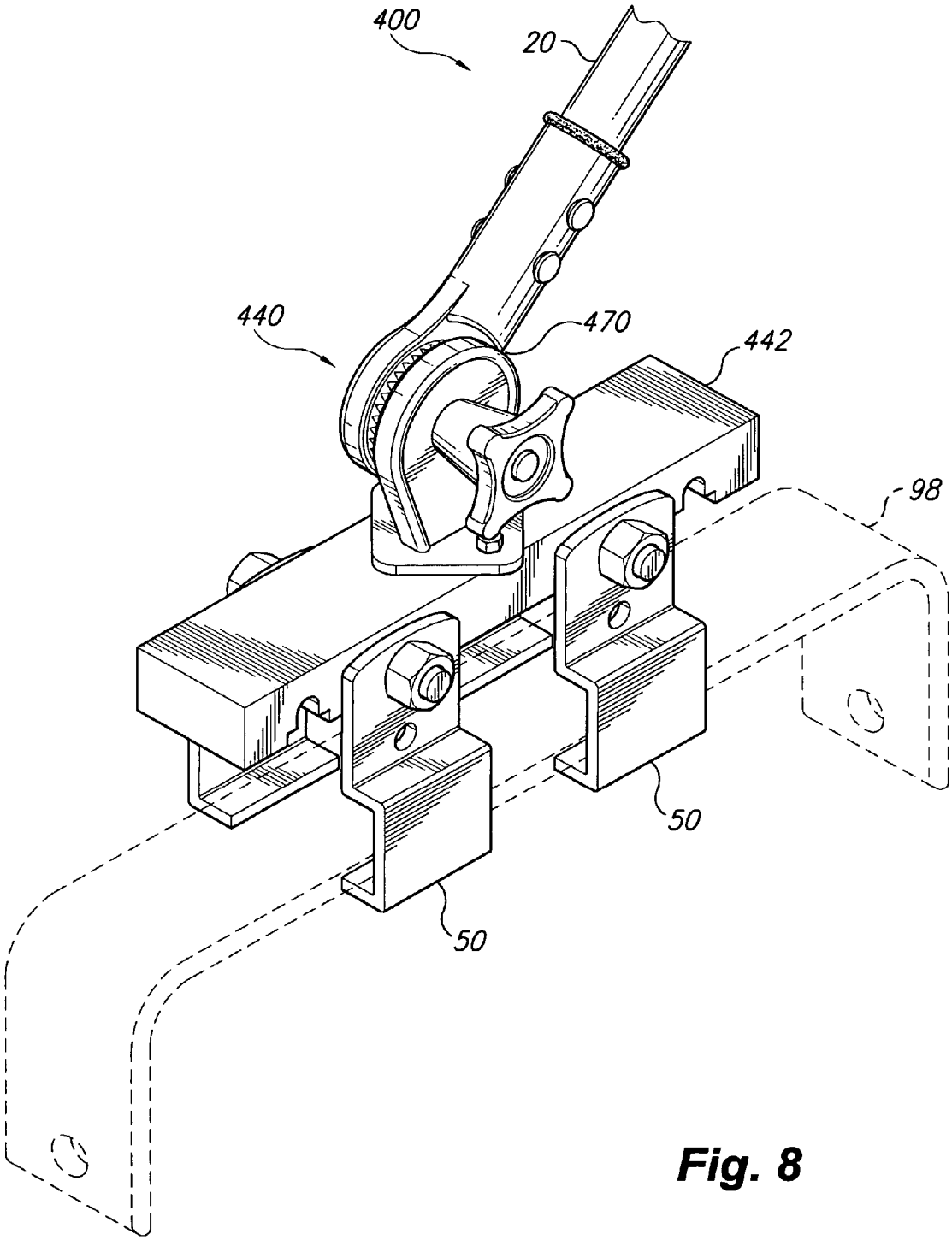
FIG. 8 is a perspective view of a third embodiment of an ergonomic appliance handle according to the present invention.
Figure 9:
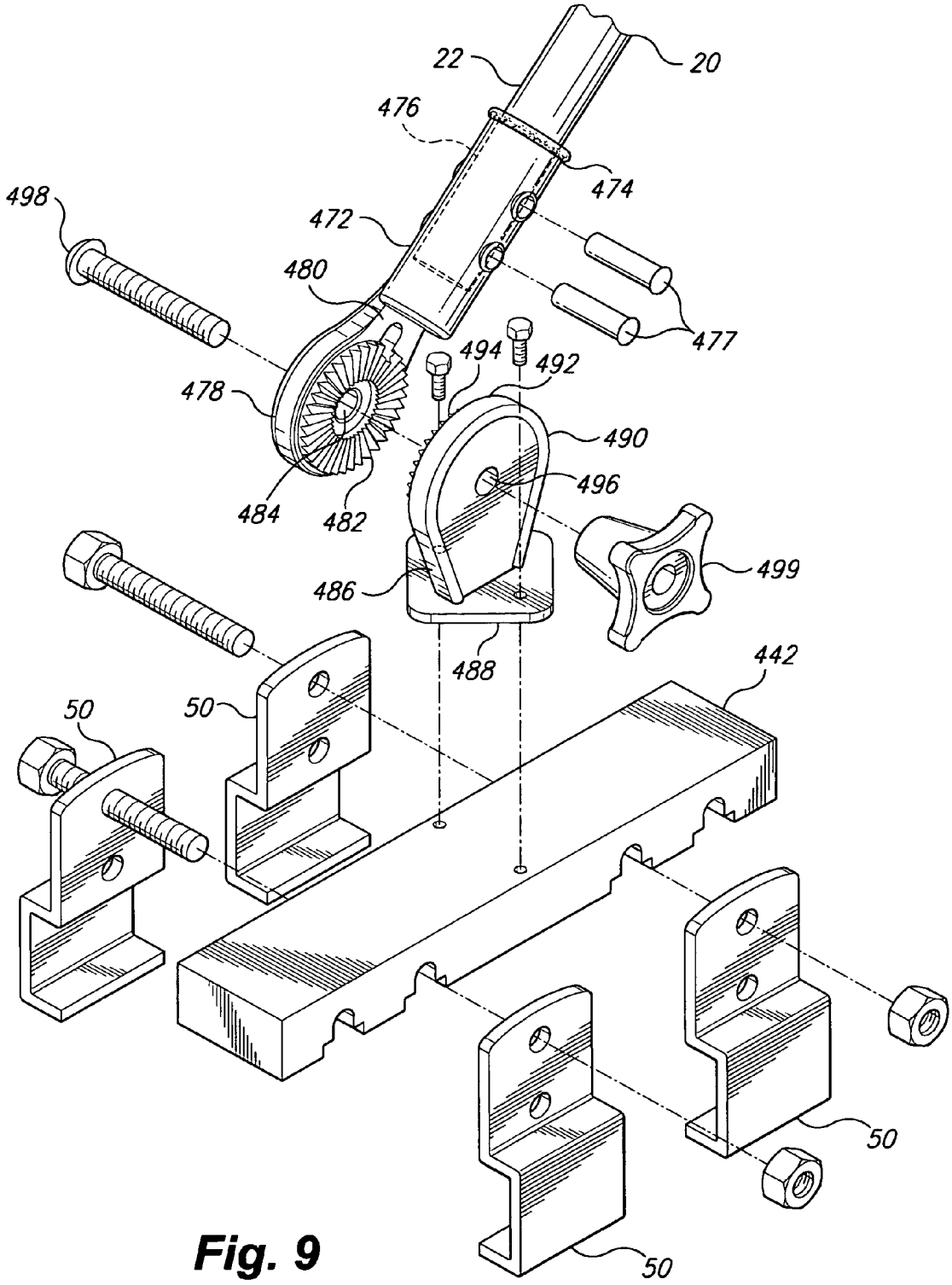
FIG. 9 is an exploded perspective view of a mounting bracket and handle coupling fixture for the ergonomic appliance handle illustrated in FIG. 8.

Turning now to FIGS. 8 and 9, a third embodiment of an ergonomic appliance handle 400 is shown. The ergonomic appliance handle 400 employs a mounting assembly 440 that allows the angle of the elongated shaft 20 to be varied. The mounting assembly 440 illustrated employs brackets 50 to attach the mounting assembly 440 to the carry handle 98 of a canister vacuum. The brackets 50 support a crossbar 442, the crossbar 442 being similar to the crossbar 42 described above but somewhat wider. A coupling fixture 470 is supported on the crossbar 442.

The coupling fixture 470 is comprised of two members pivotally joined to one another. A base member 486, mounted to or formed as a unitary part of the crossbar 442, is pivotally joined to a socket member 472 that retains the elongated shaft 20. The socket member 472 has a socket end 474 wherein a cylindrical recess 476 is defined and adapted to receive the proximal end 22 of the elongated shaft 20. A mating portion 478 of the socket member 472 has a generally circular, inside face 480, the inside face 480 having an aperture 484 defined in the center of the mating portion 478. A plurality of teeth 482 are formed on the inside face 480, the teeth 482 formed about, and extending radially from, the aperture 484.

The base member 486 has a mating portion 490 adapted to mate with the mating portion 478 of the socket member 472, there being an aperture 496 defined in the center of the mating portion 490 such that the mating portion 478 and the mating portion 490 may be joined by a pin or bolt 498 passing through both of apertures 484 and 496. As illustrated, the mating portion 490 of the base member 486 extends from a mounting flange 488 that is adapted for mounting onto the cross bar 442. Alternatively, the base member 486 may be formed as a unitary part of the crossbar 442. An inside face 492 (not seen) of the mating portion 490 has a plurality of teeth 494 similar to teeth 482. A nut or internally threaded thumb-turn 499, engaged with a threaded end of the pin or bolt 498, is used to clamp the mating portions 478 and 490 together with teeth 482 and 494 engaged or meshing in order to prevent the socket member 472 from pivoting relative to the base member 486. It can be recognized that loosening the nut or internally threaded thumb-turn 499 allows the socket portion and base portion to be separated to disengage teeth 482 and 494, allowing the socket member 472 to be repositioned.

It can be recognized that the coupling fixture 470 allows the elongated shaft 20 to be varied in position to accommodate users of varied heights and physical needs. Additionally, the coupling fixture 470 allows the elongated shaft 20 to be positioned, for example in a vertical position, or removed entirely for storage.

It is to be understood that the present invention is not limited to the embodiments described above, but encompasses any and all embodiments within the scope of the following claims.

I claim:

1. An ergonomic appliance handle, comprising:

an upstanding one piece crossbar having a first and second end;

a pair of C-shaped brackets disposed at each of the first and second ends of said crossbar, each of the brackets forming channels that are adapted for attachment to a carry handle on a floor appliance;

a coupling fitting, said fitting comprising a cylindrical body having a socket end and a slotted end, said socket end having a cylindrical recess defined therein, said slotted end having a slot therein and said slot being sized to straddle said crossbar, said coupling being attached to said crossbar; and an elongated handle shaft having a proximal end and a distal end, the proximal end being located within and attached to said coupling fitting.

2. The ergonomic appliance handle according to claim 1, wherein said coupling fitting is pivotally attached to said crossbar.

3. The ergonomic appliance handle according to claim 1, wherein said elongated handle shaft has a bend formed therein near the distal end to form a handle portion.

4. The ergonomic appliance handle according to claim 1, further comprising a handgrip disposed on the distal end of said elongated handle shaft.

5. The ergonomic appliance handle according to claim 1, wherein said elongated handle shaft comprises a proximal section and a distal section telescopically engaged to said proximal section, whereby said elongated handle shaft is adjustable in length.

6. The ergonomic appliance handle according to claim 1, wherein said coupling fitting comprises a base member disposed on said crossbar and a socket member pivotally joined to said base member.

7. An ergonomic appliance handle, comprising:

an elongated handle shaft having a proximal end and a distal end;

means for attaching the proximal end of said elongated handle shaft to a carry handle of a floor appliance, wherein said means for attaching comprises:

at least one C-shaped bracket adapted for attachment to the carry handle;

an upstanding one piece cross bar supported by said bracket parallel to the carry handle;

a base mating member attached directly to the crossbar, the base mating member being circular and having an inner face and a plurality of radially extending teeth disposed on the inner face;

a handle shaft mating member extending from the proximal end of the shaft, the handle shaft mating member being circular and having an inner face and a plurality of radially extending teeth disposed on the inner face; and a clamp having a threaded bolt extending through the base mating member and the handle shaft mating member and having a gripping knob threaded onto the bolt, whereby the handle shaft is pivotal about the bolt, the teeth on the inner faces meshing to prevent rotation of the handle shaft when the clamp is tightened, so that the handle shaft is selectively adjustable to an ergonomic angle for pushing and pulling the floor appliance.

8. The ergonomic appliance handle according to claim 7, wherein a bend is formed near said distal end of said elongated handle shaft to form a handle portion.

* * * * *